US005730306A

United States Patent [19]

Costa et al.

[11] Patent Number: 5,730,306

[45] Date of Patent: Mar. 24, 1998

[54] BI-DIRECTIONAL VENTING LINER

[75] Inventors: Stephen M. Costa; William P. Sibert, both of Stockton; G. Edward Campbell, Petaluma, all of Calif.

[73] Assignee: The Clorox Company, Del.

[21] Appl. No.: 292,627

[22] Filed: Mar. 31, 1994

[51] Int. Cl.[6] ..... B65D 51/16

[52] U.S. Cl. ..... 215/261; 215/363; 215/347

[58] Field of Search ..... 215/200, 261, 215/363, 347; 200/371, 372, 373, 256

[56] References Cited

U.S. PATENT DOCUMENTS

| | | | |
|---|---|---|---|
| 2,424,801 | 3/1947 | Crabbe et al. . | |
| 3,045,854 | 7/1962 | Patton . | |
| 3,071,276 | 1/1963 | Pellette et al. . | |
| 3,114,467 | 12/1963 | Montgomery . | |
| 3,448,882 | 6/1969 | Roy . | |
| 3,471,051 | 10/1969 | Cistone . | |
| 3,521,784 | 7/1970 | Gaines et al. | 215/261 |
| 3,951,293 | 4/1976 | Schulz . | |
| 4,089,434 | 5/1978 | Tagalakis et al. . | |
| 4,121,728 | 10/1978 | Tagalakis . | |
| 4,396,583 | 8/1983 | LeBoeuf . | |
| 4,765,499 | 8/1988 | von Reis et al. | 215/261 |
| 4,789,074 | 12/1988 | Han . | |
| 4,863,051 | 9/1989 | Eibner et al. . | |
| 4,884,716 | 12/1989 | Steiner | 220/371 |
| 5,117,999 | 6/1992 | Canzano et al. . | |
| 5,176,271 | 1/1993 | Painchaud et al. . | |
| 5,180,073 | 1/1993 | Fay et al. . | |
| 5,221,000 | 6/1993 | Lee | 215/261 |

FOREIGN PATENT DOCUMENTS

| | | |
|---|---|---|
| 2032892 | 5/1980 | United Kingdom . |

OTHER PUBLICATIONS

American Heritage Dictionary 1982 p. 258 definition of "Channel".

*Primary Examiner*—Joseph M. Moy
*Attorney, Agent, or Firm*—Harry A. Pacini

[57] ABSTRACT

A dual cap lining for bi-directional venting comprising a substantially round, disc-shaped, laminated, fluid-impermeable, gas-permeablematerial bottom layer, and having an extruded and cast polyethylene material top layer which is provided with apertures which communicate with the bottom layer and also communicate with channels provided on the upper surface of the top layer, and the material of construction of the laminated bottom layer is gas-permeable such that the dual lining allows bi-directional gas flow therethrough, for gases which have built-up in the interior of the connected container to safely escape by venting from the interior of the container to the external ambient atmosphere through openings existing between the spiral screw threads of the cap closure and threads of the container neck, and the reverse venting to equilibrate for relatively increased external pressure, without passage of solid or liquid material from the interior of the container through the lining to the closure and to the exterior of the container.

12 Claims, 4 Drawing Sheets

BI-DIRECTIONAL VENTING LINER

FIELD OF THE INVENTION

This invention relates to cap liners and more particularly to a dual layer liner having bi-directional venting capability for a vented closure. This invention is particularly suited for use as a bottle cap liner wherein a sealing cap is securable to a cooperating bottle or like container to enclose and seal the opening.

BACKGROUND OF THE INVENTION

Liners for sealing caps have been commonly used in the past, where the sealing cap is used on a bottle or other like container having an opening and said cap is securable to the bottle or container for enclosing the opening. Liners are relatively well known and are designed essentially to maintain a seal between the container finish land lip and the surface of the liner overlying the same, wherein said liner is placed between the sealing cap and the container. A fluid-impervious seal at the container finished land is highly desirable to prevent permeation or leakage of fluids from the container into or out of said container. These terms refer to the passage of fluid through the gap between a barrier and object such as the cap liner and the bottle or other container.

A major problem arises when the container is packaged with a product which evolves a gas or is under pressure, which pressure might increase excessively under certain conditions, such as elevated temperature and/of change in atmospheric pressure. It is desirable for the seal to be semi-permeable to the gas and permit excessive internal pressure to vent to the atmosphere, while retaining the associated liquid within the container. Thus, the breakage of the closure or the container is precluded by the release of excessive internal pressure.

Previous conventional cap liners have included one-piece or multi-layered liners constructed of materials such as corrugated fiber board, paper board, plastic, foil or the like, and may also include a coating on one or both major surfaces that is resistant to fluid permeation. Such designs, although relatively inexpensive and effective in precluding permeation, or leakage of fluids from the bottle or container, do not allow for pressure equilibration caused by liquids which off-gas or changes in external ambient pressure.

To address the above problems, venting liners have been used.

A major problem of conventional venting liners is their inability to vent with consistency at a particular pressure or a limited range of internal and external pressures within an associated container. Also perceived as a problem with conventional venting liners is their inability to reversibly vent only the gaseous portion, whereby equilibrated pressure can be maintained within the container with respect to the relatively increased external pressure.

Cap liners have been constructed of synthetic materials such as thermoplastics. U.S. Pat. No. 4,121,728, entitled "Venting Liners" shows one such cap liner having a first ply constructed of an impermeable plastic and a second ply constructed of a foamed material that is compressibly deformable. Both plies are simultaneously extruded and laminated together to form the cap liner. The first ply of the cap liner is applied to the bottle or container as the cap is secured to the container. The second ply is compressed between the bottle and the cap and urges the first ply into a sealing contact with the bottle or container.

Other examples of venting structures for relieving excessive pressure build up in a container include U.S. Pat. No. 2,424,801, which discloses one type of venting structure wherein the glassware neck is provided with a special configuration which will permit gas to escape after the gas build-up has reached a point where it will lift the liner off the neck of the glassware.

U.S. Pat. No. 3,114,467 discloses another type of seal-venting bottle cap wherein the bottle cap is provided with a special structure which permits the liner to rise up under the action of the build-up of gas pressure, the raising of the liner away from the neck of the glassware, then permits the gas to escape. These structures have the disadvantageous deficiency, while permitting gas to escape, they are also equally suitable for permitting liquid to escape. Neither '801 or '467 provide for or contemplate the possibility of pressure equalization, i.e., reverse flow of gas to equilibrate the pressure in the container with atmospheric pressure.

U.S. Pat. No. 3,448,882 relates to a liner composed of a pulpboard backing with a facing of fibrous, semi-permeable, polytetrafluoroethylene which permits the passage of gasses but is not wetted by and prevents the passage of liquid from within the container.

In many instances, while various structures and liners for sealing bottles or containers are available, they all suffer from major deficiencies. While the structures will permit gas to escape, they are not all equally suitable for preventing liquid from escaping. In some cases escaping liquid can damage the material for one or more portions of the liner structure.

Although cap liners such as U.S. Pat. Nos. 4,121,728 and 4,789,074 are more effective than cardboard or pulpboard cap liners against fluid permeation or leakage, such cap liners inherently require relatively expensive materials and manufacturing techniques. For example, the second ply in the '728 patent provides an imperfect and co-extensive layer of deformable material, even though only a relatively small portion of the second ply is actually compressed between the sealing lip of the bottle and the cap. The remainder of the second ply is not required to mechanically reinforce the first ply, therefore the non-essential material in the second ply represents an unnecessary expense.

U.S. Pat. 4,789,074 discloses a cap liner comprising a first substantial fluid-impervious film, a second compressible resilient "foraminous" reinforcing web bonded to the first film, whereby when the cap closure is secured to the bottle, it must compress the foraminous web between the bottle and the cap resiliently urging the film into sealing contact therewith. In the invention of '074 the foraminous web acts as a spring to force the film, or fronting, into sealing engagement with the top of the bottle finish. Therefore, the web in the '074 patent must resiliently urge the film, or fronting, into sealing contact by a compressive force necessarily exerted thereby during the closure sealing process by the torque provided by the interaction of the threaded bottle cap with the threaded top of the bottle.

U.S. Pat. No. 3,071,276 utilizes a porous paper backing while U.S. Pat. No. 4,789,074 (Han) utilizes a cap liner of a first substantial fluid impervious film and a second compressible resilient foraminous reinforcing web bonded to the first film where the cap closure is secured to the bottle wherein it must compress the foraminous web between the bottle and the cap resiliently urging the film into the sealing contact.

This reference, U.S. Pat. No. 4,121,728 described above, while having grooves thereon, appear to have several variations from the instant invention. The sealing liner in '728 does not appear to off-gas through to the bottom of the inside or lower panel to the top of the second ply of the closure and then to the sides of the closure. In '728, the sealing liner inside panel and the sides of the closure are meant to deform and retract the sealing means by the pressure of built-up gases in the sealed container, such that by defacing the lower ply, it is lifted up, forming a vent channel and then off-gassing to the sides of the closure. This type of off-gasing can result in fluid leakage if the package is tipped. Utilizing a porous backing, such as disclosed in U.S. Pat. No. 3,071,276 (Pellet) or U.S. Pat. No. 3,448,882, each of which utilizes a pulpboard or porous paperboard backing with a microporous plastic facing are unacceptable as sealing backing for sealing closures because of chemical compatibility with aggressive materials, such as hypochlorite. Also these liners are not effective at allowing gas into the container to equilibrate external pressure increases.

With reference to U.S. Pat. Nos. 4,121,728 and 3,045,854 (Patton), although each of these contains grooves or channels extending laterally across the side surface of the disc, they do not incorporate a porous backing which is semi-permeable and which allows the gases to vent therethrough to channeling which exists on the upper surface of the laminated disc whereby the gases are permitted to off-gas through the sides of the closure.

In view of the foregoing, it is a primary object of the present invention to eliminate the disadvantages heretofore noted by providing a novel venting liner which vents under any closure applied torque, while at the same time being capable of utilization of a non-venting liner.

The primary object of this invention is to provide a novel bi-directional venting liner for closures which includes a disk-shaped member defined by at least two plies or layers of material which may or may not be deformable when subjected to a compressive force and wherein grooves or channels are provided on the upper surface of the top layer, although subjected to compressive force, are not compressed. Off-gassing built-up gases from the enclosed container to the atmosphere is by a mechanism whereby the gases are passed directly to the upper surface of the top layer, beneath the closure, the gases travel along the associated channels to the inside of the closure, and then escapes to the atmosphere by way of openings existing between the spiral screw threads of the closure and threads of the container neck which in effect forms a continuous channel for the escaping gas. A reverse mechanism is contemplated for the equilibration of pressures when the pressure in the container is less than the external ambient atmospheric pressure with the entering air to the continuous channel between the cap threads and the container neck thereunder.

SUMMARY OF THE INVENTION

This invention is directed to a dual lining for a vented closure. The lining facilitates venting of internal pressure from a connected container containing a material which develops an associated gas under pressure which might increase excessively under certain conditions (such as elevated temperatures or decreases in atmospheric pressure). Conversely, the lining of this invention used with a cap closure facilitates equilibration of pressure associated with a decrease in internal pressure or increase in temperature or increase in atmospheric pressure. When in place, the liner of this invention prevents the flow of liquid.

The dual lining comprises a substantially round, disc-shaped, laminated, fluid-impermeable, gas-porous, material fronting or bottom layer, and having elastomeric (an extruded and cast polyethylene) backing or top layer. The backing is provided with apertures which communicate to the back of the front or bottom layer and also communicate with grooves or channels provided on the upper surface of the backing. The construction of this improved dual lining for a vented closure allows gases, which have built-up in the interior of the connected container, to safely escape by venting from the interior of the container through the bottom layer to the sides of the closure and out to the external ambient atmosphere, without passage of liquid from the interior of the container through the lining to the closure and to the exterior of the container.

In its preferred form, the bottom layer is constructed of material permeable to reverse flow of external air from ambient atmospheric conditions into the container. At the same time as providing for venting from the sealed container interior to the external ambient atmosphere, the preferred dual lining of this invention provides for equilibration of the internal pressure with the external ambient atmospheric pressure by reverse semi-permeable flow of pressure to the interior of the container. Containers, which are filled with liquid or other material and having a vapor space thereabove are susceptible to "paneling" or partial collapse of the container wall when the external temperature drops or the external pressure increases. This situation will also take place when a container is taken from a higher altitude to a lower altitude, or when a sealed container is subjected to a cooler temperature, thereby causing a partial vacuum in the sealed container. Therefore, reverse air flow or bi-directional venting, will diminish this problem. By means of the instant dual lining, equalization of the internal pressure and the external pressure is achieved without cap and liner removal. Thus, during equalization of a reduced pressure in the container, no impurities can penetrate into the container from the outside. The novel closure lining of this invention prevents emergence of liquid or solid from the container upon an accidental inclination or tipping of the container.

In view of the above and other objects that will hereinafter become evident, the nature of the invention will be more clearly understood by reference to the following detailed description, the appended claimed subject matter and several views illustrated in the accompanying drawings.

DESCRIPTION OF THE PREFERRED EMBODIMENT

Figure 1:
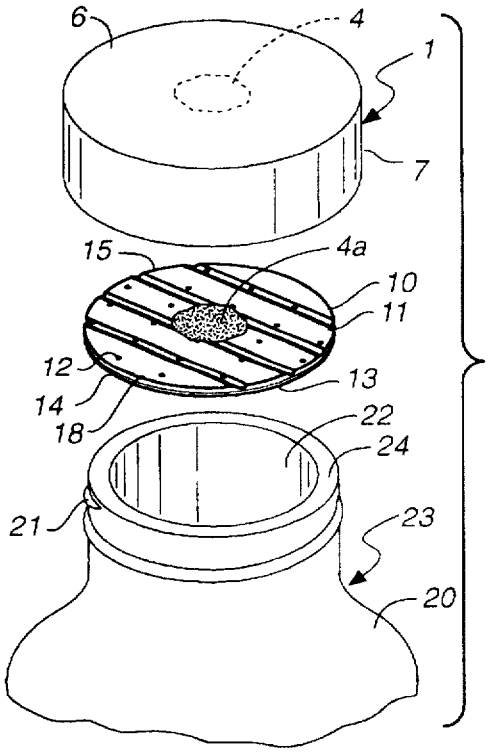
FIG. 1 is an exploded view of an annular container top, a cooperative cap and cap liner constructed according to the invention.

Referring now to the drawings, FIG. 1 shows a bottle or like container 23, said bottle or container having the usual screw threads 21, including a neck 20 and opening communicating through said neck to the interior of the bottle or container 23. Cap 1 is provided for closure of the opening 22 and is securable to the bottle 23 by threads 21 on the neck 20 of the bottle or container engaging cooperating threads 3 on the cap, as is known in the prior art. Other alternative means for closure may be used to secure the cap and bottle, such as a snap closure in FIG. 6.

Figure 3:
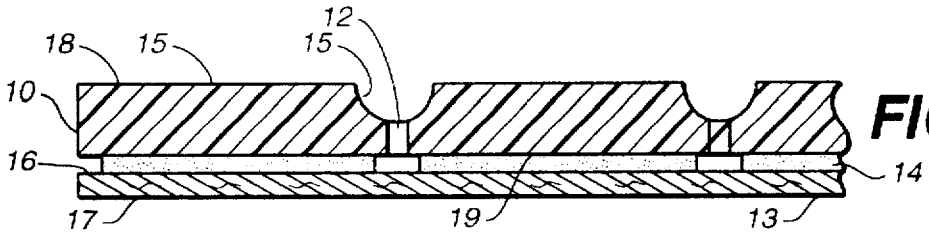
FIG. 3 is a cross-sectional view along plane 3—3 of the cap liner of FIG. 2.

Cap liner 10 is provided for mounting in the cap 1 and sealing between the cap 1 and the bottle or container opening 22. Specifically, said sealing is circumferentially about the container opening and against the lip. The construction of the cap liner 10 is shown in detail in FIG. 3. The construction of the cap liner includes a substantially disc-shaped bottom or first layer 13 and top or second layer 15. Said bottom layer is constructed from a substantially fluid-impermeable, gas-porous material having opposing first and second major surfaces 16 and 17, respectively. The cap liner also includes a top or second laminated layer 15 of an elastomeric material bonded to said first layer to said second major surface thereof. The bottom layer is constructed of a flexible material having gas permeability that is chemically inert in respect to the intended contents of the container and maintains substantial fluid impermeability for effectively sealing the container. The preferred material of construction of the first or bottom layer 13 is a gas porous material of a non-woven or spunbonded olefin, such as polyethylene, which is fluid-impermeable, but gas-permeable. Therefore, any semi-permeable or semi-porous material can be used for the bottom layer.

The top layer 15 is disc-shaped to correspond to and be co-extensive with the facing bottom layer 13 and said top layer includes at least one channel extending across the surface thereof. Preferably the top layer 15 has a plurality of channels 11 transversely extending about the diameter of the disc and across the surface intersecting the circumference. The channeled surface of the top layer optionally contains spaced-apart apertures 12 therethrough such that at least one open aperture 12 is in communication with at least one open channel groove. Preferably, a plurality of apertures 12 will intersect with at least one channel. Alternatively, with deep channeled surfaces wherein the channel exposes the first layer of semi-permeable material, no spaced apart apertures may be required in the channel groove. In typical 40 mil elastomeric material used for the top layer, channel depth may range between about 0.01 mil to 40 mil, preferably between about 10 mil to 30 mil, and more preferably between about 15 mil to 20 mil. The channels 11 with spaced apart apertures 12 in the channel grooves are spaced and configured so that they do not reduce the strength of the material of the top layer. Therefore the apertures 12 may be placed in a definite pattern to maximize the cooperation with the channels 11, or the apertures may be randomly patterned such that at least one aperture 12 is placed in at least one channel. The appropriate thickness and surface area produces a composite dual layer liner with overall density and strength equivalent to conventional cap liners. The material of construction of the second layer has limited compressibility or resilience, particularly in the direction perpendicular to the first and second major surfaces thereof. In most applications, the second layer will be substantially thicker than the first layer of fluid impermeable gas porous material. It is important that among the apertures at least one aperture remain open to transport the gases upon ingress or egress therefrom.

In its broadest form, the second layer includes one or more of transverse grooves or channels with spaced openings or apertures of any size, shape or arrangement of said openings or apertures extending therethrough and cooperating with the grooves and channels. In its preferred form, the cap liner of this invention includes a second layer having a plurality of parallel grooves with spaced openings or apertures therethrough to the first surface 16 of the bottom layer 13. Formation of the apertures 12 may be provided in various ways. In the simplest instance, these apertures are openings 12 usually having straight sides, e.g. with diameters of about 0.020 inches to about 0.035 inches, and can be formed in the top layer 15 by use of a mechanical means for perforating or by laser means for forming perforations in the material. Formation of the apertures in the top layer is performed prior to the lamination of the top layer and the bottom layer.

This invention relates to a bi-directional venting closure wherein the closure utilizes a liner of elastomeric material as the top layer 15 and a bottom layer 13 of various materials, including woven, non-woven and films having microporous semi-permeable characteristics. Materials which can be used for the bottom layer include, but are not limited to, polyolefins, polyesters, polytetrafluoroethylenes, and other polymeric materials. Examples of non-woven, processed materials are carding, airlay, needlepunch, spunlaced, spunbonded, melt blown and various finishing means, including the traditional napping, sueding, tigering and brushing. By "elastomeric" material is meant a material which has the ability to essentially recover its original shape partially or completely after a deforming force has been removed. Natural rubber, elastomers, such as styrene-butadiene, poly-chloroprene, nitrile rubber, butyl rubber, polysulfide rubber, cis-1,4-polyisoprene, ethylene-propylene terpolymers, silicon rubber and polyurethane rubber, thermo-plastic polyolefin rubbers, and styrene-butadiene-styrene are acceptable materials of construction for the bottom layer.

In the preferred embodiment of this invention, the formation of the dual liner vented closure of this invention utilizing a bottom layer 13 of fibrous spunbonded material and a top layer 15 of extruded and cast polyolefin, such as polyethylene, the preferable lamination process is used when a hot-melt adhesive 14 is applied between the bottom layer and the top layer. A hot melt adhesive is preferred for its quick curing properties. Cold adhesives are usable but not preferred. Further, preferably the adhesive is applied to the top polyethylene layer 15 in measured amounts and in a pattern which avoids the open communicating apertures or channels in the top layer. For example, adhesive application can be conveniently carried out with a print wheel with a selected pattern or random pattern, by a dotted orientating spot application and the like. Alternatively, the adhesive may be applied onto the first surface 16 of the bottom layer 13 of fibrous spunbonded material. The application of laminating adhesive must avoid the apertures 12 in the top layer 15 where the apertures are placed in the grooves of channels 11; wherein said apertures pass through to communicate with the bottom layer.

Figure 2:
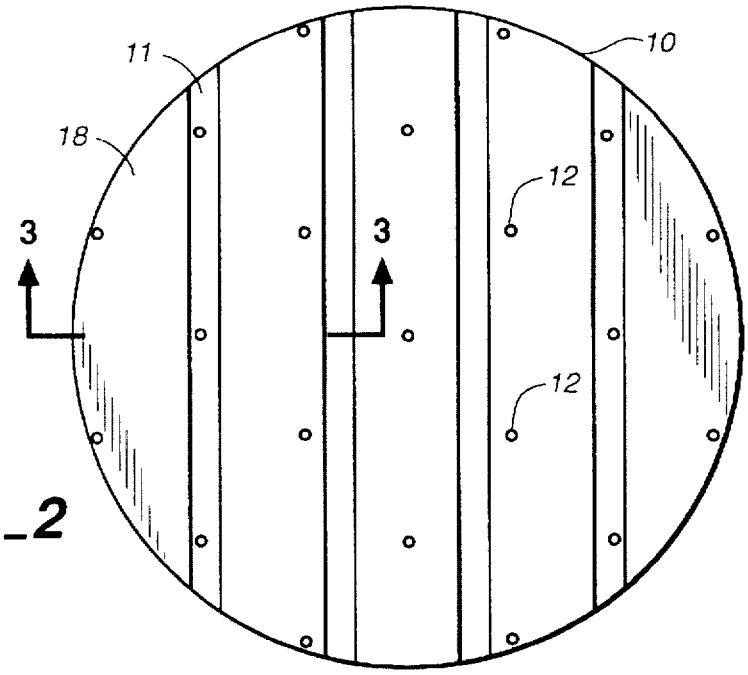
FIG. 2 is an enlarged detailed top view of the cap liner of FIG. 1.
Figure 8:
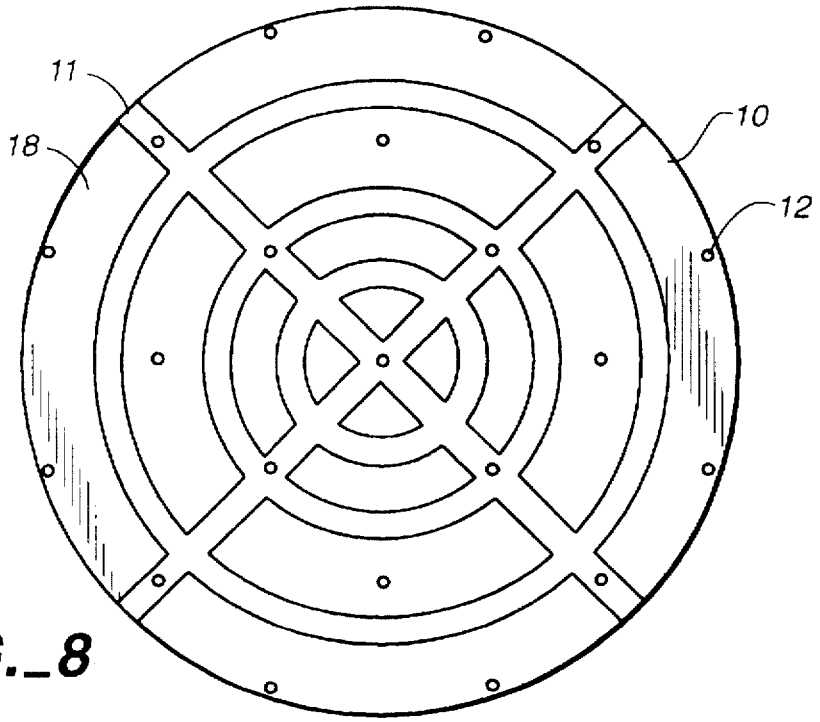
FIG. 8 is an enlarged detailed view of a cap liner according to this invention with an alternative channel pattern.
Figure 9:
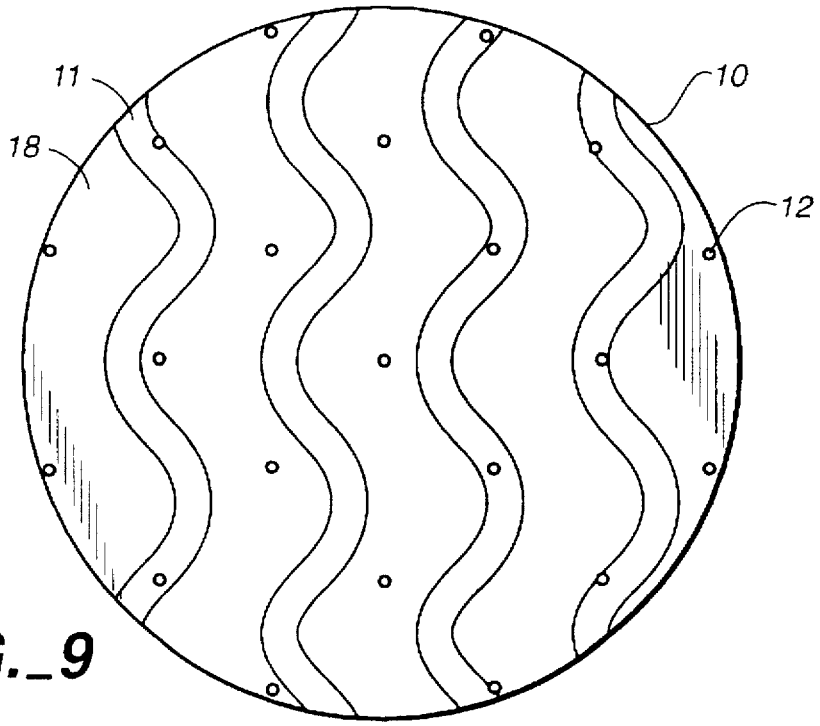
FIG. 9 is an enlarged view of a cap liner according to this invention with yet another channel pattern.

In FIG. 2, the top layer 15 as illustrated is easily and inexpensively formed. The top layer 15 thus formed consists of a plurality of parallel spaced channels in which spaced apart apertures 12 have been placed through the top layer to cooperate with the bottom layer 13. Said apertures do not extend through the bottom layer 13. Parallel channels are selected to facilitate the process parameters. Thereby, a lightweight, strong, channeled layer is produced at the top layer 15 that has limited compressibility and limited resiliency in the direction perpendicular to the first 18 and second 19 surfaces. Channeling of various shapes and forms may be used, provided at least one channel extends to the circumference of the disc and provided cooperating apertures are not blocked by bonding adhesive 14. Some blockage of cooperating apertures 12 is acceptable, provided a sufficient number of apertures remain open to carry the gas movement in or out of the container. The channels are illustrated as being in parallel relationship to each other extending across the entire surface of the disc, but in keeping with this invention the channels need not be parallel so long as portions of said channels extend to the perimeter of the disc-shaped liner as illustrated in FIGS. 8 and 9.

Figure 6:
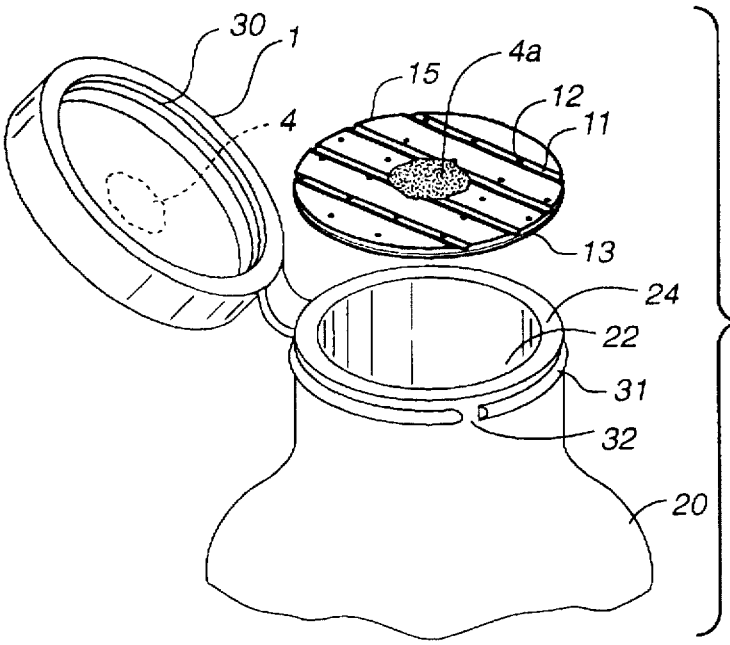
FIG. 6 is an exploded view of a container, cooperative cap and cap liner constructed according to the present invention wherein the cap is a snap closure.
Figure 7:
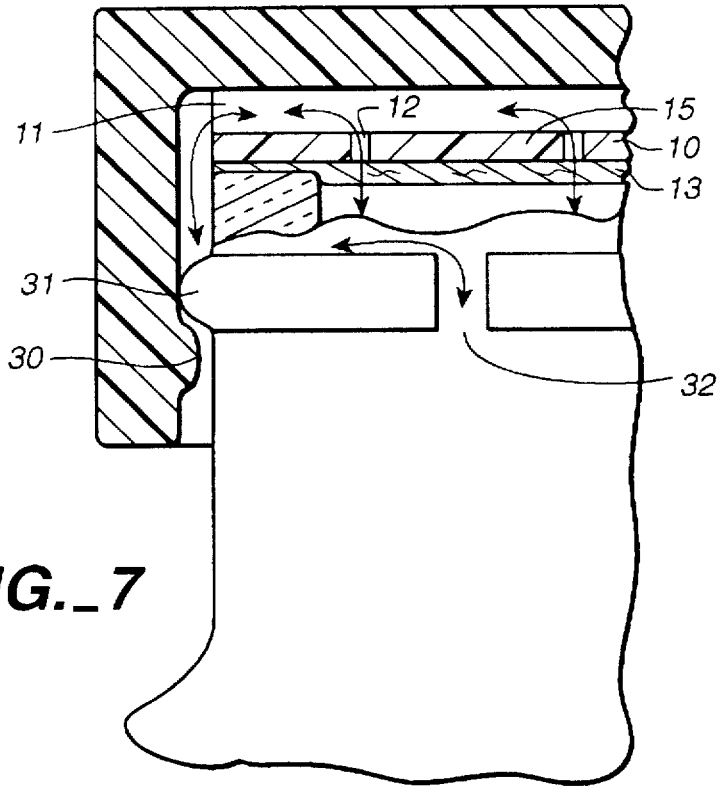
FIG. 7 is an enlarged fragmentary sectional view similar to FIGS. 4 and 5 with a snap closure in place and illustrating the manner in which venting occurs when the closure is securely snapped onto the container neck finish.

With more specific reference to the drawings, the neck 20 of a conventional receptacle, such as a bottle or other container 23 provided with usual screw threads 21 indicated at FIG. 1 and with an upper annular sealing surface 24 along the top thereof. The screw cap 1 has a top or end panel 6 and a depending skirt 7 with a continuous threads 3. The cap is secured on the neck 20 by cooperative relation between the threads 3 and 21 and in such manner that the cap can be drawn downwardly in the usual manner by applying torque thereto to compress a deformable liner between the cap as the sealing means as it is understood in the art. It will also be understood that instead of using a continuous thread type of cap and bottle neck or jar or similar container having a similar finish, a "snap-type" cap may be employed as represented in FIGS. 6 and 7 and the corresponding container neck with a retaining annular set collar.

In operation the dual liner cap insert is cut in the form of a disk about the size of the inside area of the closure to provide a close fit therewith. The liner is provided with at least one groove or channel with a minimum of one extending laterally across the second major surface 18 of the top layer 15 of the disk to intersect the circumference and parallel to the diameter thereof. Preferably the liner is provided with a plurality of spaced grooves or channels 11 extending laterally across the second major surface 18 of the top layer of the disk and parallel to the diameter thereof. The grooves or channels 11 are preferably spaced equally across the face of the disk; however, a random pattern in the top layer is acceptable. The raised area between the channels or grooves will come in contact with the inner surface of the cap as the cap is drawn downwardly onto the liner surface as torque is applied to the cap. Similarly, if a snap-type cap is used, when the cap is snapped in place, the inside of the cap 1 will come in contact with the area between the channels on the second major surface of the second layer of the disk liner. The areas between the channels or grooves will be slightly distorted when the closure is tightened thus sealing the container opening against any fluid leakage with the first major surface of the first layer. The channels or grooves remain open to the edge of the cap, at which point the grooves act as channeling for accommodating the ingress or egress of gases to equalize the pressure between the interior of the container and the atmospheric pressure. The bottom layer of the dual liner is forced against the annular opening 24 of the container and forms a liquid impermeable seal therewith.

The liner 10 is preferably placed inside the cap 1. To assist in holding the liner in place to the end panel when the cap is removed during use, a small amount of adhesive 4 may be used. Although internal adhesive 4 is not necessary, it is preferred to use a small spot amount of an adhesive 4 applied to the end panel under cap 2 to hold the liner in place in the cap 1, care is taken not to close the vent apertures with adhesive.

Figure 4:
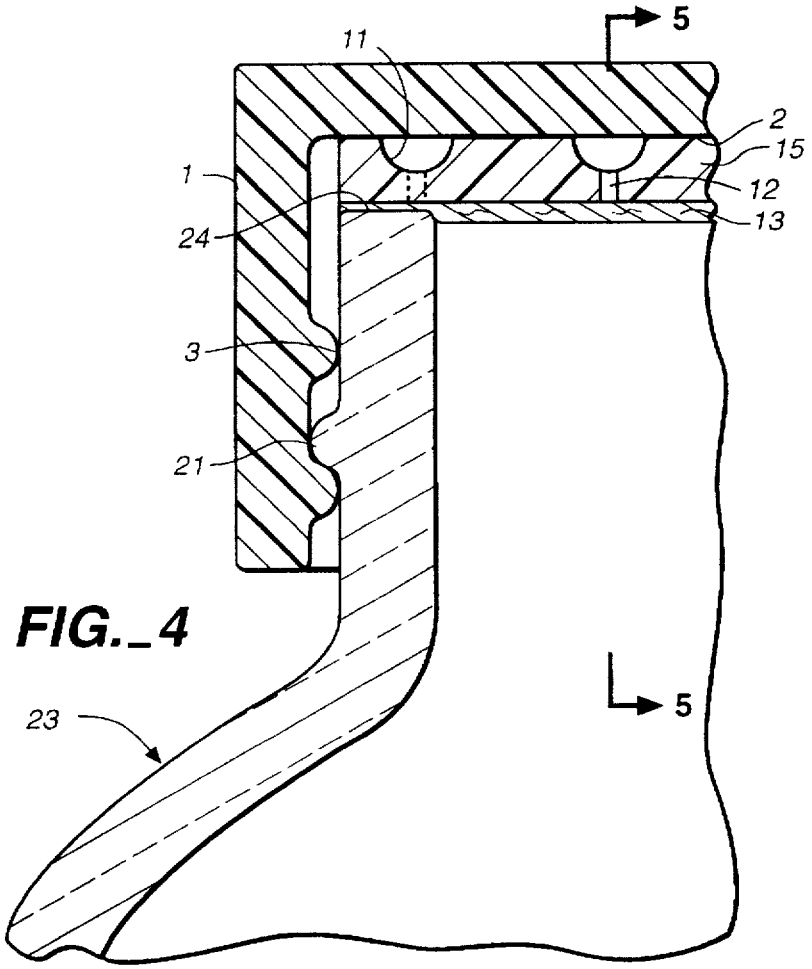
FIG. 4 is a cross-sectional view of the cap, cap liner, sectional view in enlarged format taken through a closure container neck and liner to illustrate the liner in place with the closure secured to a container neck finish.
Figure 5:
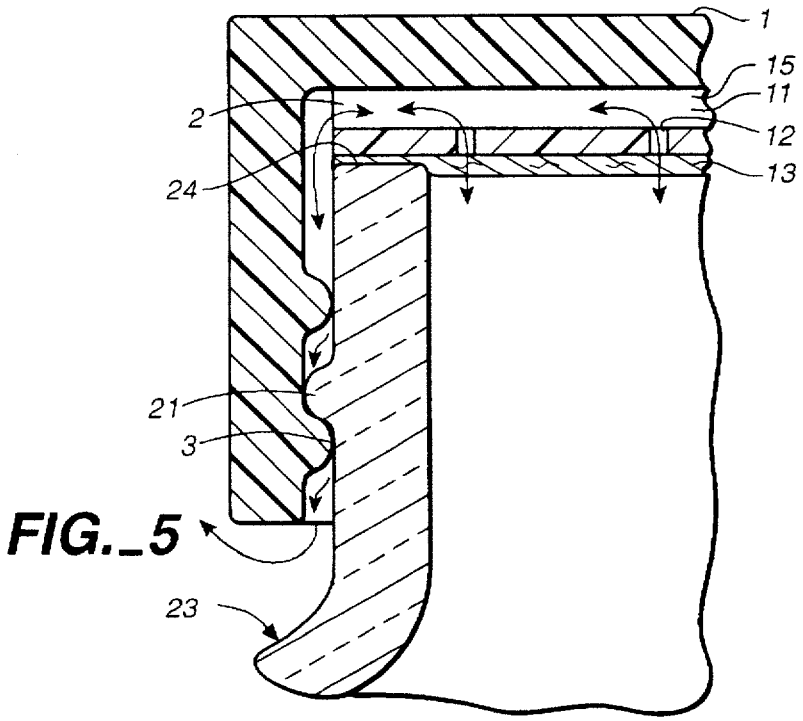
FIG. 5 is an enlarged fragmentary view similar to FIG. 4 and illustrates a dual liner venting disc of this invention showing the manner in which the venting occurs when the cap closure is in place on a container neck finish.

The interior gas will penetrate through the gas-permeable lower layer contacting at least one aperture 12 in the first major surface in the channels of the second layer, then by following at least one channel to the circumference of the liner 10, the gases are forced out through the spiral thread to the external atmosphere. Conversely, with the decrease of pressure in the container the exterior air will enter through the spiral grooves into the channels of the second layer into the openings in said channels therethrough into the container through the semi-permeable first layer. Referring to FIG. 6, in the instance of a snap-type closure an opening or slit 32 is left in the annular set collar to permit escaping gases or entering gases to pass therethrough to or from the atmosphere. In further operation, container cap closure 1 is secured to the bottle or container such as by threads 3 cooperating engaging threads 21 on the inner surface depending skirt of the closure of the cap. As shown in FIG. 4, a cap closure is secured to a container by cooperative threads 3 and 21, a minimum torque is usually applied in tightening the cap to ensure the effective seal against liquid leakage. Subsequently, a limited release torque within a specified range is applied to the cap to loosen or remove it from the opening of the bottle or container. The tightening with the desired application torque presses the bottom layer 13 as a sealing layer against the circumference of the opening 22 of the container 23. Further, the lower layer is concentrically urged by the bottle cap against the first layer to seal the circumferential lip of the bottle or container. The first major surface 18 of said top layer 15 is urged against the inside end panel of the bottle cap 2 with limited compressibility and deformation. The channels and corresponding optional spaced apart apertures therethrough remain functional. Thereby the bottle or container is simultaneously sealed against liquid permeation through the bottom layer of the cap liner 10 and leakage between the cap liner 10 to the bottle. However, since the dual lining is gas permeable through the bottom layer vented gases from the bottle or container 23 are able to penetrate the bottom layer 13 while the liquid is effectively sealed against leakage by the compression of the bottom layer 13 against the lip of the bottle or container. Although the cap liner 10 effectively seals against leakage by the cap, due to the gas permeability of the bottom layer, vented gases escape through the bottom layer, through the apertures 12 extending through the top layer 15 in the channels 11 thereon to the inside of the cap. With the presence of the channels 11, the gas is directed to the inside circumference of the cap and passes to the ambient atmosphere. A reverse path is followed for equilibrating the pressure in a reduced pressure situation described hereinabove.

One principle difference over the prior art is that the facing material of the bottom layer having its first surface 13 adjacent the container opening when the cap liner is secured in place to the container is not a conventional, non-porous sheeting material normally used as a facing. It is preferred to use a fibrous, non-woven, spunbonded polyolefin as a facing material. An example of a spunbonded polyolefin available for use is a material sold under the tradename "Tyvek" by DuPont Company, Inc. Tyvek is a material composed of randomly arranged, continuous filament fibers which are spun textile fibers and heat sealed to one another to form a web. Other materials of construction as described hereinabove may be used as long as they possess the property of a semi-permeable membrane, i.e., gas permeabilility or fluid impermeability. Therefore, the material used for the bottom layer is gas-permeable, so that gases, which form in the container during storage or transfer, may penetrate the bottom layer and vent to the atmosphere through the connecting apertures in the top layer to the channels therein and then into the atmosphere through the screw threads in the neck of the container and the screw threads on the inside of the cap closure. Typically the thickness of the bottom layer is from about 0.004 inches to about 0.005 inches.

The facing material, first layer or bottom layer of the laminate is formed from a membrane which has the ability under normal operating conditions to permit the passage of gas, but to prevent the passage of liquid. As suck, it functions as a semi-permeable membrane. However, it has been found that some material when used with bleach or other potentially corrosive liquids has a tendency to permit some wetting of the backing material. Therefore these potentially corrosive liquids attack the conventional backing material causing its deterioration. Consequently, instead of using conventional pulpboard lining materials and the like, and in order to use a limited compressible material, it is preferred to use a second layer of extruded and cast polyolefin, preferably polyethylene, having both channel grooves and communicating apertures therethrough. Other types of materials may also be used for the first layer as long as they possess the property of fluid impermeability and gas permeability.

Tests have shown that with this arrangement of dual linings for vented closures as described herein, readily vent internal or external pressure or equilibrate pressure differences between the container and the atmosphere the build-up of internal pressures within bottles containing bleach, but the semi-permeable first layer prevents the bleach from leaking past the facing when the bleach bottle is not upright and this prevents the bleach from attacking the liner materials or working its way past the liner to drip down the outside surface of the bottle and attack the bottle label, the packaging case carrying the bottle, or the shelf supporting the bottle in the store. Also store clerks and consumers handling the bottle are protected from contact with the bleach material in the bottle.

FIG. 2 shows grooves or channels 11 in the liner to obtain a sealing and venting dual lining cap liner. The grooves or channels are formed on the cap liner surface of the top layer 15 side adjacent to the cap top 2 closure and extends laterally across the central portion of the disk. In other words, the closure herein shows the basic embodiments of the invention. First, a smooth top layer 15 with grooves or channels 11 having apertures 12 therein where the raised areas between the grooves or channels contact the side adjacent the under portion of the closure or cap 2; second a smooth underside of a first layer making a fluid impervious seal on the container while allowing gases to escape through the gas permeable layer. And third, venting or gas escape through the spiral threads of the neck closure.

The foregoing specification has set forth the invention in its preferred practical form, but it will be understood that the structure shown is capable of modification within a range of equivalence without departing from the spirit and scope of the invention which is to be understood as broadly novel and commensurate with the appended claims.

What is claimed is:

1. A bi-directional venting cap liner comprising:

(a) a substantially disc-shaped bottom layer of substantially fluid-impermeable, gas-porous material;

(b) said bottom layer having opposing first and second surfaces wherein said first surface is adjacent to a container opening when the cap liner is secured in place to a container;

(c) a substantially disc-shaped top layer of elastomeric material having opposing first and second surfaces, said second surface of said bottom layer is laminated to said first surface of said top layer; and (d) said second surface of said top layer having at least one channel therein extending across said surface and having spaced apart apertures therethrough in communication with said channel on the second surface of the top layer and in communication with said second surface of said bottom layer.

2. The cap liner of claim 1 wherein said channels on the second surface of said top layer intersects the circumference of said top layer.

3. The cap liner of claim 1 wherein at least one of said apertures is in open communication with a channel.

4. The cap liner of claim 1 wherein said second surface of said top layer has a plurality of radial channels on the surface thereof.

5. A bi-directional venting cap liner for a closure comprising a substantially disc-shaped member wherein said disc-shaped member being defined by at least two layers;

(a) a bottom layer of substantially fluid-impermeable, polyolefin, gas-porous material;

(b) said bottom layer having opposing first and second surfaces wherein said first surface is adjacent to a container opening when the cap liner is secured in place to a container;

(c) a top layer of elastomeric material having opposing first surface and second surfaces; said second surface of said bottom layer is laminated to said first surface of said top layer; and (d) said second surface of said top layer having at least one channel therein extending across said surface and having spaced apart apertures therethrough in communication with the channels on the second surface of the top layer and in communication with said second surface of said bottom layer.

6. The venting cap liner according to claim 5 wherein said bottom layer is made of fibrous, spunbonded material and said top layer is of extruded and cast polyolefin.

7. The venting cap liner according to claim 5 wherein said bottom layer is made of fibrous polyethylene and said top layer is made of extruded and cast polyethylene.

8. The venting cap liner according to claim 5 wherein said bottom layer is made of polytetrafluoroethylene and said top layer is made of elastomeric material.

9. A combined container and closure comprising a container body including an opening with a circumferential sealing lip, a cap closure including an end panel and a depending skirt having means for removably securing said cap closure to said container body in close relationship with said opening, a bi-directional venting liner interposed between said opening and said end panel of said cap closure comprising:

(a) a substantially disc-shaped bottom layer of substantially fluid-impermeable, gas-porous material;

(b) said bottom layer having opposing first and second surfaces wherein said first surface is adjacent to a container opening when the cap liner is secured in place to a container;

(c) a substantially disc-shaped top layer of polyolefin having opposing first and second surfaces with limited deformation when torque is applied to close the container opening against fluid leakage; said second surface of said bottom layer is laminated to said first surface of said top layer; and (d) said second surface of said top layer having at least one channel therein extending across said surface and having spaced apart apertures therethrough in communication with the channels on the second surface of the top layer and in communication with said second surface of said bottom layer and at least one channel remaining open to the edge of said cap closure when the cap closure is secured to the opening.

10. The container and closure combination as defined in claim 9 wherein said bi-directional venting liner bottom layer is of fibrous, non-woven, spunbonded olefin and said top layer is of extruded and cast polyolefin.

11. The container and liner combination as defined in claim 9 wherein said liner second surface of said top layer has a plurality of channels extending across said surface and intersecting with the circumference.

12. The container and closure combination as defined in claim 9 wherein said depending skirt has a threaded inner surface arranged to define in cooperation with a threaded container opening when secured thereon a gas passageway from said channels on said second surface of said top layer and in communication with the threaded depending skirt to ambient atmosphere.

* * * * *